US007029371B1

(12) United States Patent
Bird

(10) Patent No.: US 7,029,371 B1
(45) Date of Patent: Apr. 18, 2006

(54) JIG FOR GUIDING A GRINDER

(75) Inventor: Derek A. Bird, Murrysville, PA (US)

(73) Assignee: Siemens Power Generation, Inc., Orlando, FL (US)

( * ) Notice: Subject to any disclaimer, the term of this patent is extended or adjusted under 35 U.S.C. 154(b) by 0 days.

(21) Appl. No.: 11/156,299

(22) Filed: Jun. 17, 2005

(51) Int. Cl.
*B24B 49/00* (2006.01)
*B24B 51/00* (2006.01)

(52) U.S. Cl. ..... 451/11; 451/139; 451/280; 451/342

(58) Field of Classification Search ..... 451/11, 451/158, 159, 139, 280, 342, 439, 487
See application file for complete search history.

(56) References Cited

U.S. PATENT DOCUMENTS 1,429,819 A * 9/1922 Worth ..... 451/285
1,434,896 A * 11/1922 Hill ..... 451/285
1,448,239 A * 3/1923 Schuessler ..... 451/159
2,105,175 A * 1/1938 Anderson ..... 451/42
2,806,327 A * 9/1957 Coburn ..... 451/123
2,846,828 A * 8/1958 Pilon, Sr. ..... 451/441
3,300,906 A * 1/1967 Young et al. ..... 451/158
4,271,638 A * 6/1981 Creech ..... 451/439
4,428,158 A * 1/1984 Fatula, Sr. ..... 451/123
4,741,128 A * 5/1988 Reaves et al. ..... 451/439
4,928,435 A * 5/1990 Masaki et al. ..... 451/159
5,245,792 A * 9/1993 Liechti et al. ..... 451/5
5,293,718 A * 3/1994 Favaron ..... 451/21

* cited by examiner

*Primary Examiner*—David Thomas
*Assistant Examiner*—Robert Scruggs

(57) ABSTRACT

A jig is structured to guide a grinder along the inner surface of the base or cover of a combustion turbine. The jig includes a base having a bottom surface with a plurality of rollers arranged in substantially the same radius as the portion of the casing being repaired. Side rollers locate the base horizontally during movement. A top platform may restrain the base vertically by supporting a pivot block that bears against the rotor of the turbine. The grinder may be moved vertically or horizontally with respect to the base upon which it is secured.

18 Claims, 9 Drawing Sheets

JIG FOR GUIDING A GRINDER

BACKGROUND OF THE INVENTION

1. Field of the Invention

The present invention relates to the repair of combustion turbines. More specifically, the invention provides a jig for guiding a grinder and resizing of portions of a turbine casing that have been repaired by welding.

2. Description of the Related Art

The vanes, or non-rotating blades, within a combustion turbine are typically secured to either the cover or base of the turbine by rings known as blade diaphrams. These rings and the corresponding non-rotating blades sit into channels defined within the casing, with the channels defining hook fits along their sides to secure the blade diaphragms and corresponding non-rotating blades in place.

Combustion turbines are subjected to a harsh operating environment, given both the temperature and the pressure of the gas flowing therethrough. It is therefore occasionally necessary to perform repairs to the hook fits of the combustion turbine by welding various portions of the casing.

Each section of the base and the cover of the casing corresponding to each row of blades and/or veins has a different diameter. Therefore, after welding is performed, grinding down the wells to restore the dimensions of that portion of the casing is difficult. In the past, hand grinding was used, but this is very time consuming, and is also a very difficult process with which to obtain the proper dimensions within the desired tolerance.

While the cover of the casing may be grinded using a grinder guided by a boring bar mounted substantially along its longitudinal axis, the use of a boring bar on the base would require removal of the rotor, which would add approximately six weeks to the time required to complete the repair.

Accordingly, there is a need for a jig that is structured to guide a grinder along a weldment within the base or cover of the combustion turbine, so that the proper dimensions and tolerances may be quickly achieved during grinding. Such a jig would not only cut down on the time required for repair, but would also increase the accuracy with which the desired dimensions may be achieved in the repaired casing.

SUMMARY OF THE INVENTION

The present invention provides a jig for guiding a grinder along either the base or cover of a turbine casing.

The jig includes an elongated base, a bottom surface that is curved along its length to correspond to the curve of one section of a combustion turbine casing. Because the diameter of the casing will be different in different locations, a different jig must be used for each row of blades and/or veins. A plurality of rollers are disposed along the bottom surface, thereby permitting the jig to roll along the casing. Additional rollers are disposed along each side of the jig, with the rollers on one side being structured to reciprocate towards and away from that side. The reciprocating rollers are spring biased away from that side, so that these rollers in conjunction with the rollers on the other side will properly locate the jig while resisting lateral movement of the jig during grinding.

A grinder support assembly is secured to the top of the base. The grinder support assembly includes means for securing a grinder, and means for moving the grinder vertically and horizontally with respect to the base. In some preferred embodiments, the means for horizontal movement include a grinder clamp block secured to the grinder support assembly by a plurality of bolts disposed within slots defined within a grinder clamp block, so that the grinder clamp block may be moved laterally by loosening the bolts, repositioning the grinder clamp block, and then retightening the bolts. The vertical movement of the grinder is accomplished by a slide and slide base secured to each other by a dovetail connection. The base is fixedly secured to the jig base, while the slide is secured to an L-shaped bracket upon which the grinder clamp block is secured. The screw lift mechanism may be provided to raise and lower the slide with respect to the slide base.

The jig may further include means for bearing against the rotor of the turbine, thereby pressing the jig into the base. These means include a spring bar supported above the base by four support rods, with a pivot block secured above the spring bar. The pivot block is secured to the spring bar by a plurality of bolts, with springs being disposed on the bolts for biasing in the pivot block away from the platform. The pivot block may therefore be drawn closer to the platform by tightening the bolts, and is permitted to be pushed away from the platform under spring pressure by loosening the bolts. The pivot block may therefore be pulled towards the platform to insert the jig within the repair location, and then permitted to bear against the rotor to guide the movements of the jig by loosening the bolts.

Alternatively, the jig may include means for engaging a rotating guide bar secured substantially along the longitudinal axis of the cover of the casing. The guide bar may be rotatably mounted in this location and rotated by a motor. The jig may be connected to the guide bar by one or more support legs extending between a spring block secured to the spring bar, and a clamp secured around the guide bar. The rotation of the guide bar, as controlled by the motor, will move the jig along the appropriate path to grind the weld repaired portions to their appropriate size.

Accordingly, it is an object of the present invention to provide an apparatus for grinding portions of a combustion turbine casing that have been repaired by welding back down to size without removing the rotor.

It is another object of the invention to provide a jig for a grinder that will guide the grinder through the proper path to grind the weld repaired sections of a combustion turbine casing down to the proper dimensions.

It is a further object of the invention to provide a jig for guiding a grinder along weld repaired sections of a combustion turbine casing, and providing for both horizontal and vertical movement of the grinder with respect to the jig to properly locate the grinder with respect to the casing.

It is another object of the invention to provide a jig for guiding a grinder along a portion of a combustion turbine casing that is secured within the proper path both vertically and horizontally.

It is a further object of the invention to provide a method of grinding weld repaired sections of combustion turbine casings back to the desired size that is both less time consuming and more accurate and consistent than prior repair methods.

These and other objects of the invention will become more apparent through the following description and drawings.

BRIEF DESCRIPTION OF THE DRAWINGS

Like reference characters denote like elements throughout the drawings.

DETAILED DESCRIPTION OF THE PREFERRED EMBODIMENTS

The present invention provides a jig structured to guide a grinder along a circumferential channel within the base or cover of a combustion turbine casing, thereby facilitating the grinding of weld repairs to the appropriate dimensions. The jig is particularly useful for grinding hook fits after they have been repaired by welding.

Figure 1:
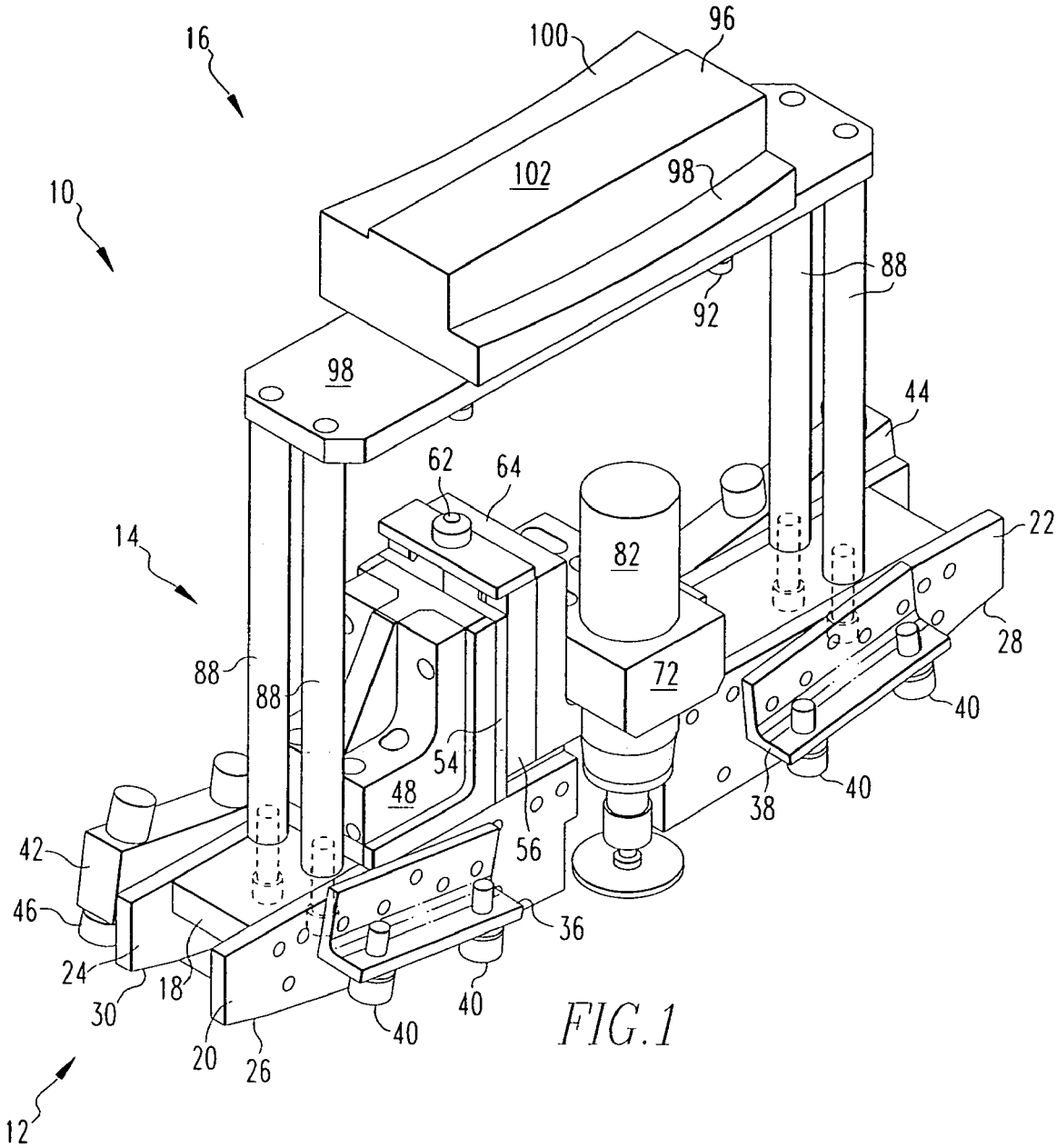
FIG. 1 is an isometric side view of a jig for a grinder according to the present invention.
Figure 2:
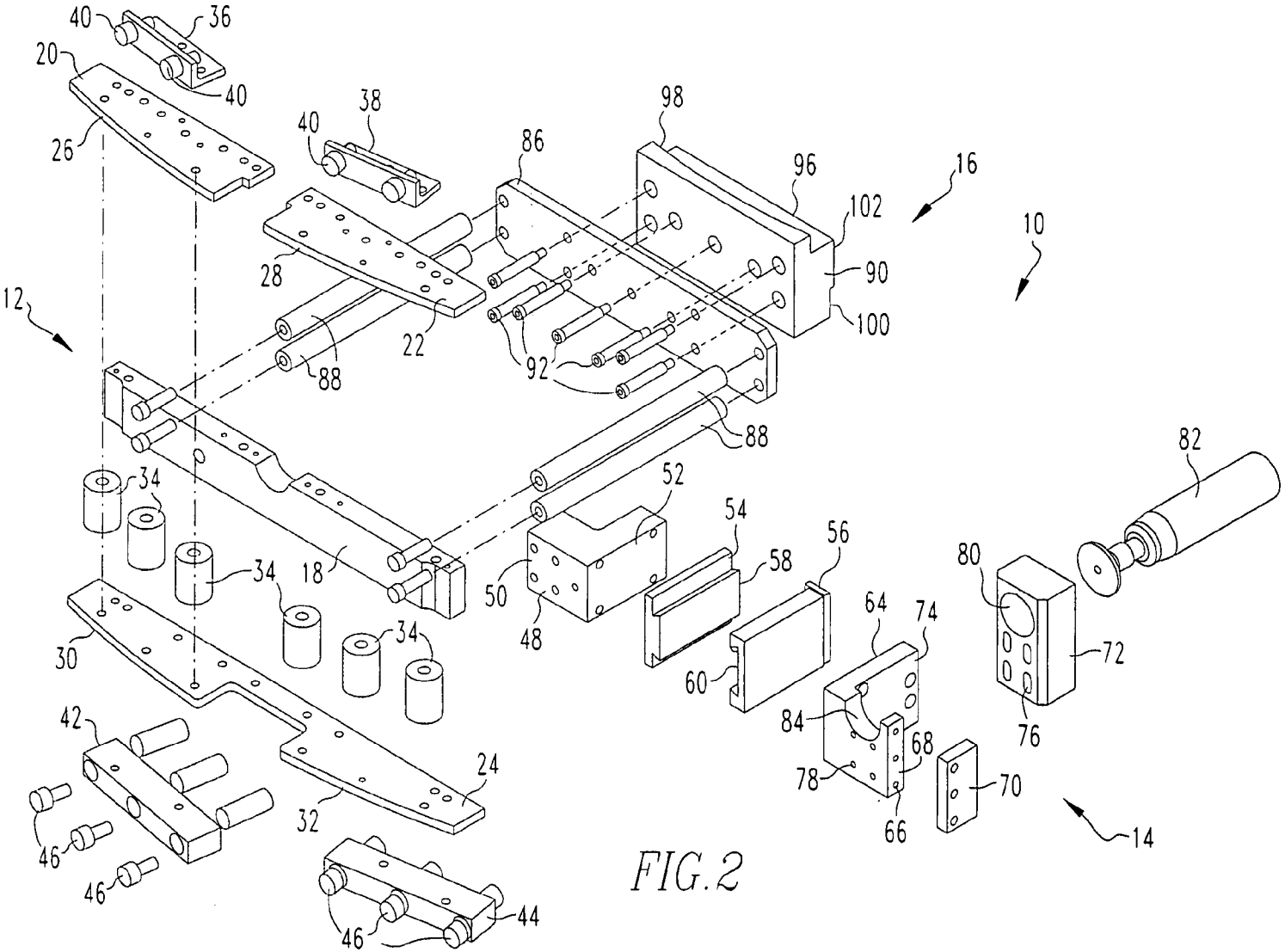
FIG. 2 is an exploded isometric side view of a jig for a grinder according to the present invention.

Referring to FIGS. 1 to 2, the jig 10 includes a base assembly 12, a grinder support assembly 14, and an upper spring assembly 16.

The base assembly 12 includes a base 18 having a pair of front side plates 20, 22 secured to one side, and a back side plate 24 secured to the opposing side. The front side plates 20, 22 and the back side plate 24 depend downward from the base 18, defining lower curved surfaces 26, 28, 30, 32, each of which has a radius structured to conform to the radius of a row defining portion of the combustion turbine to be repaired using the particular jig 10. Accordingly, each row of blades and vanes within the turbine requires a separate jig 10. A plurality of bottom rollers 34 are rotatably secured between either the front side plate 20 and back side plate 24, or the front side plate 22 and the back side plate 24. Each front side plate 20 has a front roller bracket 36, 38 secured thereon. Each of the front roller brackets 36, 38 has a pair of front rollers 40 mounted thereon, with the front rollers 40 being structured to engage a vertical surface. Some preferred embodiments may include front rollers 40 which are spring biased outward, away from the front side plates 20, 22. Similarly, a pair of back roller brackets 42, 44 are secured to the back side plate 24. Each of the back roller brackets 42, 44 have a plurality of back rollers 46 rotatably mounted thereon, with the back rollers 46 being structured to engage a vertical surface. The rollers 46 may have a fixed location with respect to the back side plate 24.

The grinder support assembly 14 includes a base angle plate 48 having a bottom surface 50 and side surface 52. The bottom surface 50 is rigidly secured to the base 18, and the side surface 52 is rigidly secured to the slide base 54. The slide base 54 and slide 56 define mating male 58 and female 60 dovetail portions, so that the slide 56 is permitted to slide vertically with respect to the slide base 54. It will be obvious to those skilled in the art that the male dovetail portion 58 and female dovetail portion 60 may be reversed. A screw lift mechanism 62 (FIG. 1) is provided within the slide 56, and is structured to raise the slide 56 relative to the slide base 54 when turned in a first direction, and to lower the slide 56 relative to the slide base 54 when turned in a second direction. A grinder angle plate 64 is secured to the slide 56. The grinder angled plate 64 defines a shelf 66 having an end 68. A grinder clamp block guide 70 is secured to the end 68 of the grinder angle plate 64. A grinder clamp block 72 is slidably secured upon the shelf 66, restrained between the grinder clamp block guide 70 and the vertical portion 74 of the grinder angle plate 64. The grinder clamp block 72 defines a plurality of elongated slots 76 therein, corresponding to the substantially round holed 78 defined within the shelf 66. Bolts passing through both the slot 76 and hole 78 secure the grinder clamp block 72 to the shelf 66. Loosening the bolts permits the grinder clamp block 72 to slide with respect to the shelf 66. The grinder clamp block further defines a grinder aperture 80 structured to secure a grinder 82 therein. The shelf 66 may define a channel 84, which is also structured to accommodate the grinder 82.

The upper spring assembly 16 includes a spring bar 86 held above and secured to the base 18 by a plurality of rods 88, with a preferred embodiment including one rod 88 securing each corner of the base 18 to a corner of the spring bar 86. A pivot block 90 is secured to the spring bar 86 by a plurality of bolts 92, which are surrounded by springs 94 (FIG. 3) disposed between the spring bar 86 and pivot block 90, so that the springs 94 bias the pivot block 90 away from the spring bar 86. The pivot block 90 defines an upper surface 96 structured to engage a rotor of a combustion turbine. A preferred configuration of the upper surface 96 includes the concave surfaces 98, 100, disposed along either side of the pivot block 90, with a raised, substantially flat surface 102 therebetween.

Figure 3:
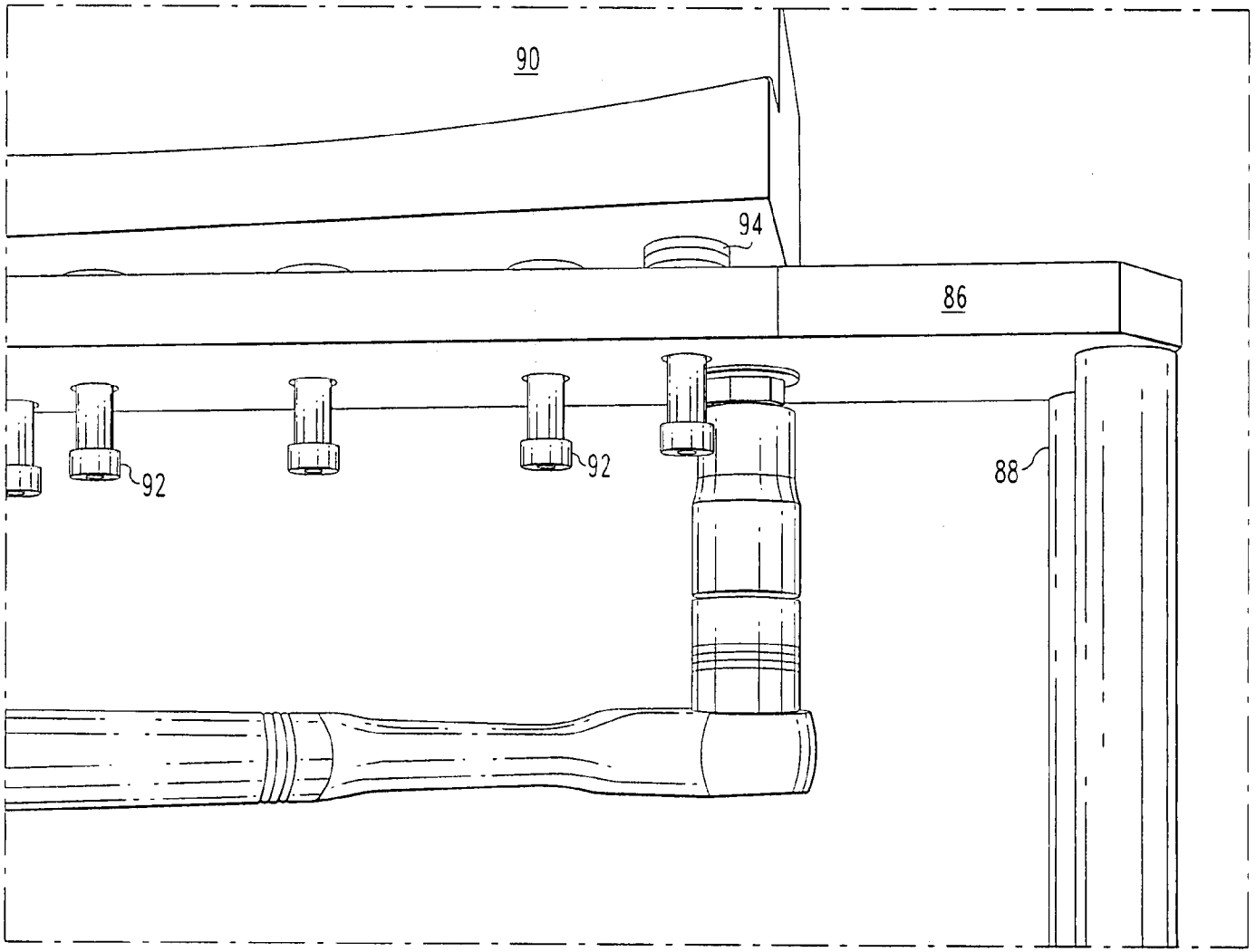
FIG. 3 is a side view of an upper portion of a jig for a grinder according to the present invention, illustrating adjustment of a pivot block thereon.
Figure 4:
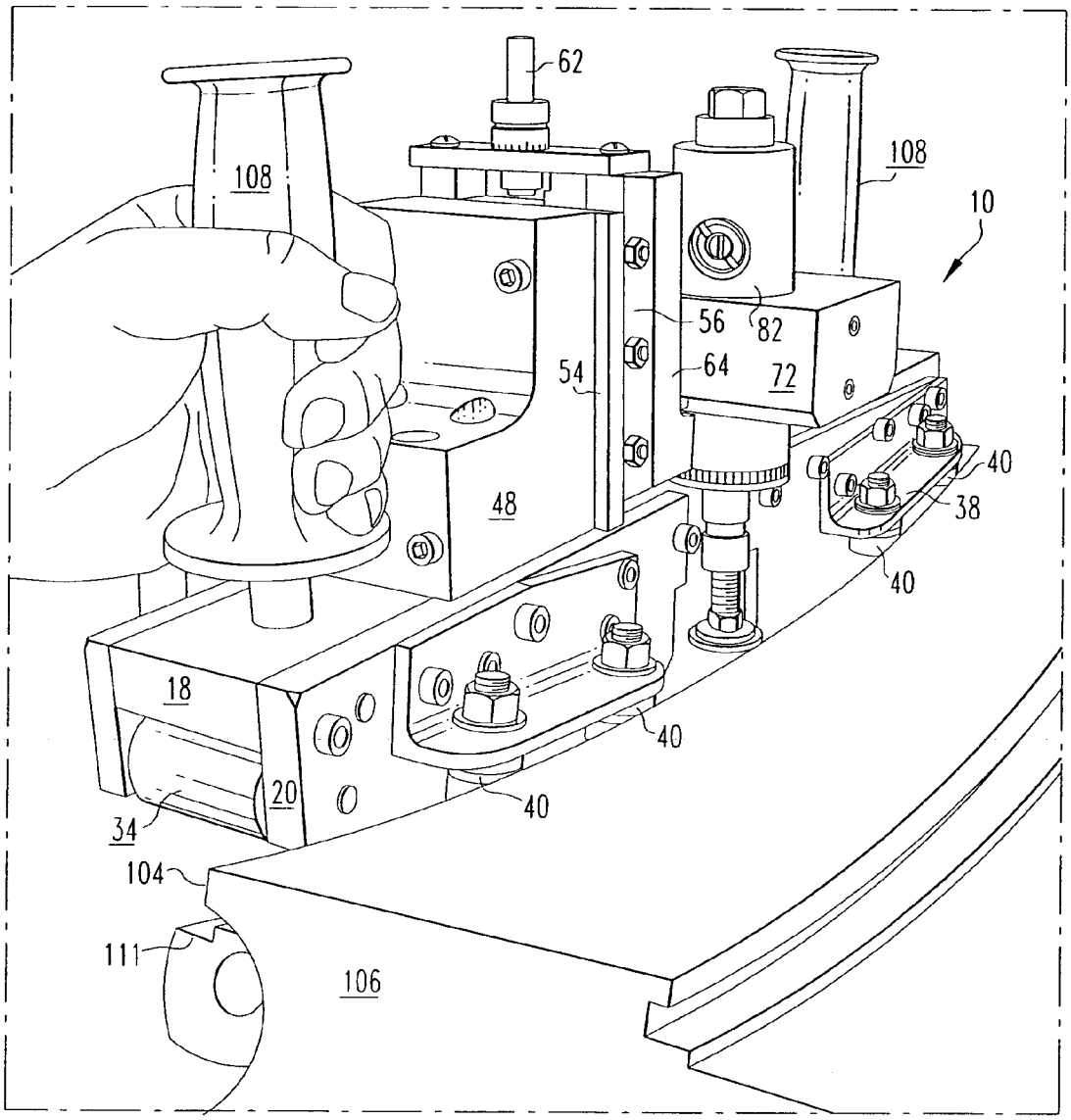
FIG. 4 is an environmental isometric end view illustrating a jig according to the present invention in use, guiding a grinder along the base of a combustion turbine casing.

In use, the bolts 92 will be tightened to draw the pivot block 90 towards the spring bar 86 as illustrated in FIG. 3. Referring to FIG. 4, the jig 10 is then placed within a channel 104 defined within the casing 106 for retaining a diaphragm (not shown). The rollers 34 engage the bottom surface of the channel 104, and the rollers 40, 46 engage each side of the channel 104, thereby resisting lateral movement of the jig 10 within the channel 104. FIG. 4 illustrates an optional embodiment that does not include a spring bar 86 and pivot block 90, and wherein the rods 88 are replaced by the handles 108. If the embodiment of FIGS. 1 to 3 is used, then the bolts 92 will be loosened to permit the springs 94 to raise the pivot block 90 against the rotor 109 (FIG. 4). In either embodiment, the screw lift mechanism 62 will be used to raise or lower the grinder 82 as needed, and the bolts passing through the slots 76 and holes 78 will also be loosened so that the grinder 82 may be moved horizontally as needed, and then retightened. The jig 10 may then be moved back and forth within the channel 104 to grind a weld repair, for example, a repair to the hook fit 111 (FIG. 4), to the proper dimension.

Figure 5:
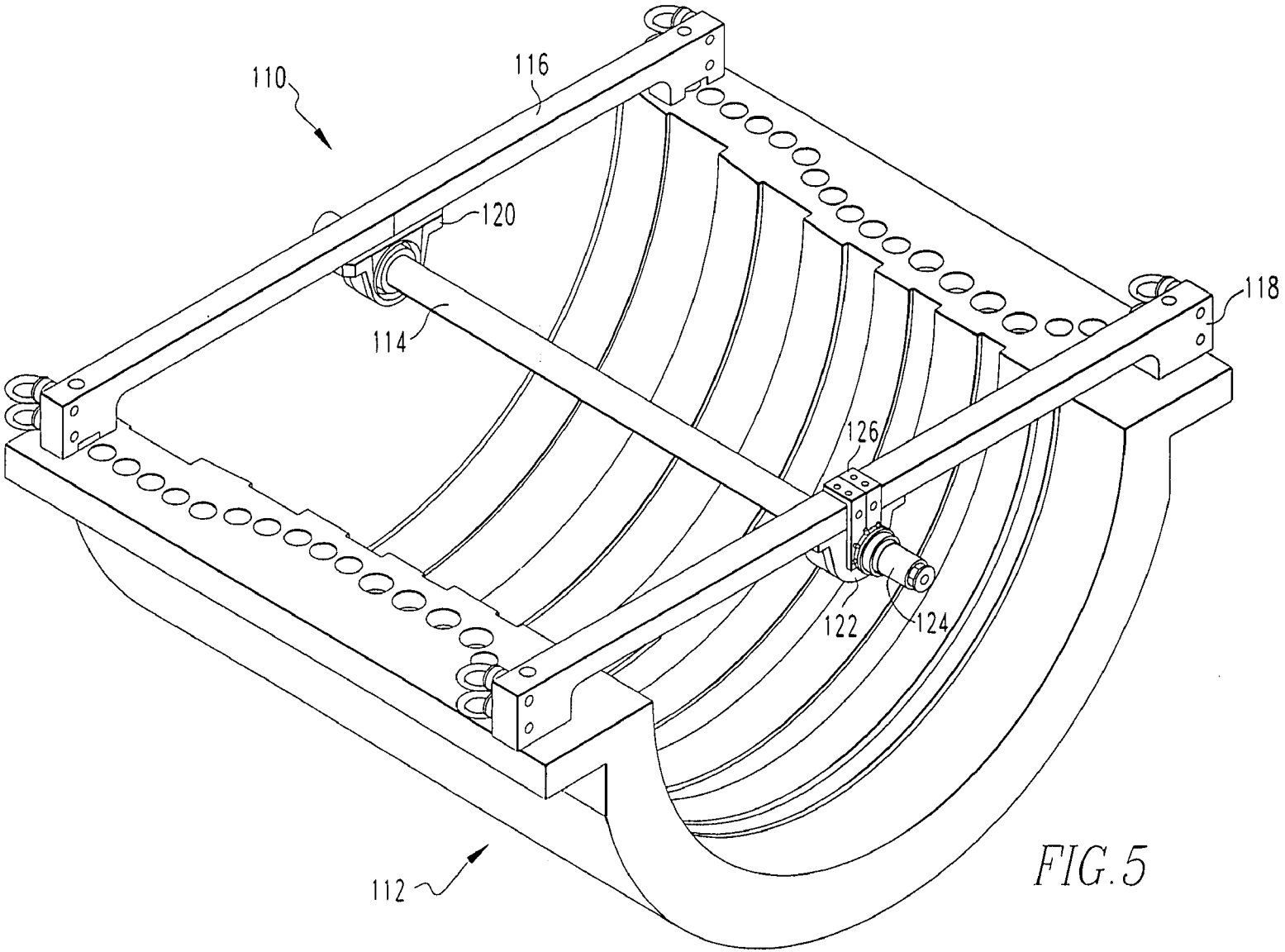
FIG. 5 is an isometric top view of a guide apparatus for a jig according to the present invention.
Figure 6:
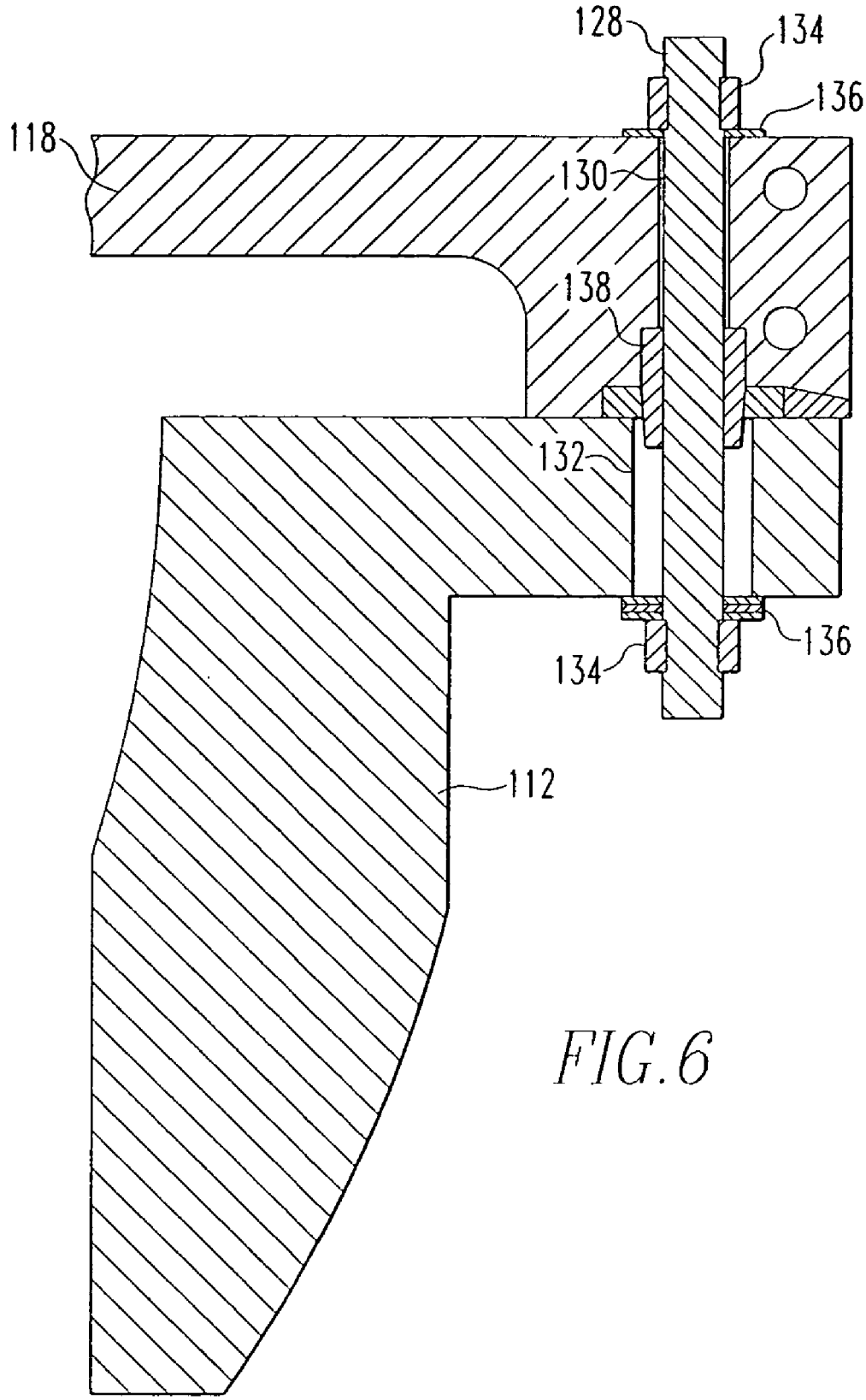
FIG. 6 is a cross-sectional end view of an attachment between a guide assembly and a casing cover according to the present invention.

Referring to FIGS. 5 to 6, a guide bar assembly 110 for guiding ajig 10 designed for repair of a cover 112 of a combustion turbine casing is illustrated. The guide bar assembly 110 includes a guide bar 114 extending between a front strap 116 and back strap 118. The guide bar 114 is rotatably secured to the front strap 116 by a bracket 120. Likewise, the guide bar 114 is rotatably secured to the back strap 118 by the bracket 122. A motor 124 may, in some embodiments, be operatively attached to one end of the guide bar 114. In the illustrated example, the motor 124 is secured to the guide bar 114 adjacent to the backstrap 118, and is secured to the backstrap 118 by the motor bracket 126.

Referring to FIG. 6, the connection between a strap 118 (which is the same as the connection for the strap 116) to the casing 112 is illustrated. A bolt 128 passes through an aperture 130 defined within the strap 118, and a second aperture 132 defined within the casing 112. The bolt 128 has a nut 134 at each end, possibly with washers 136 between the nut 134 and the strap 118 or casing 112. A bushing 138 surrounds the bolt 128 at the juncture between the strap 118 and casing 112. A small clearance, which in some embodiments may be about $\frac{1}{8}^{th}$ inch, exists between the bushing 138 and aperture 132, thereby permitting a small amount of play in the connection between the strap 118 and case in 112 as the casing 112 tends to flatten.

Figure 7:
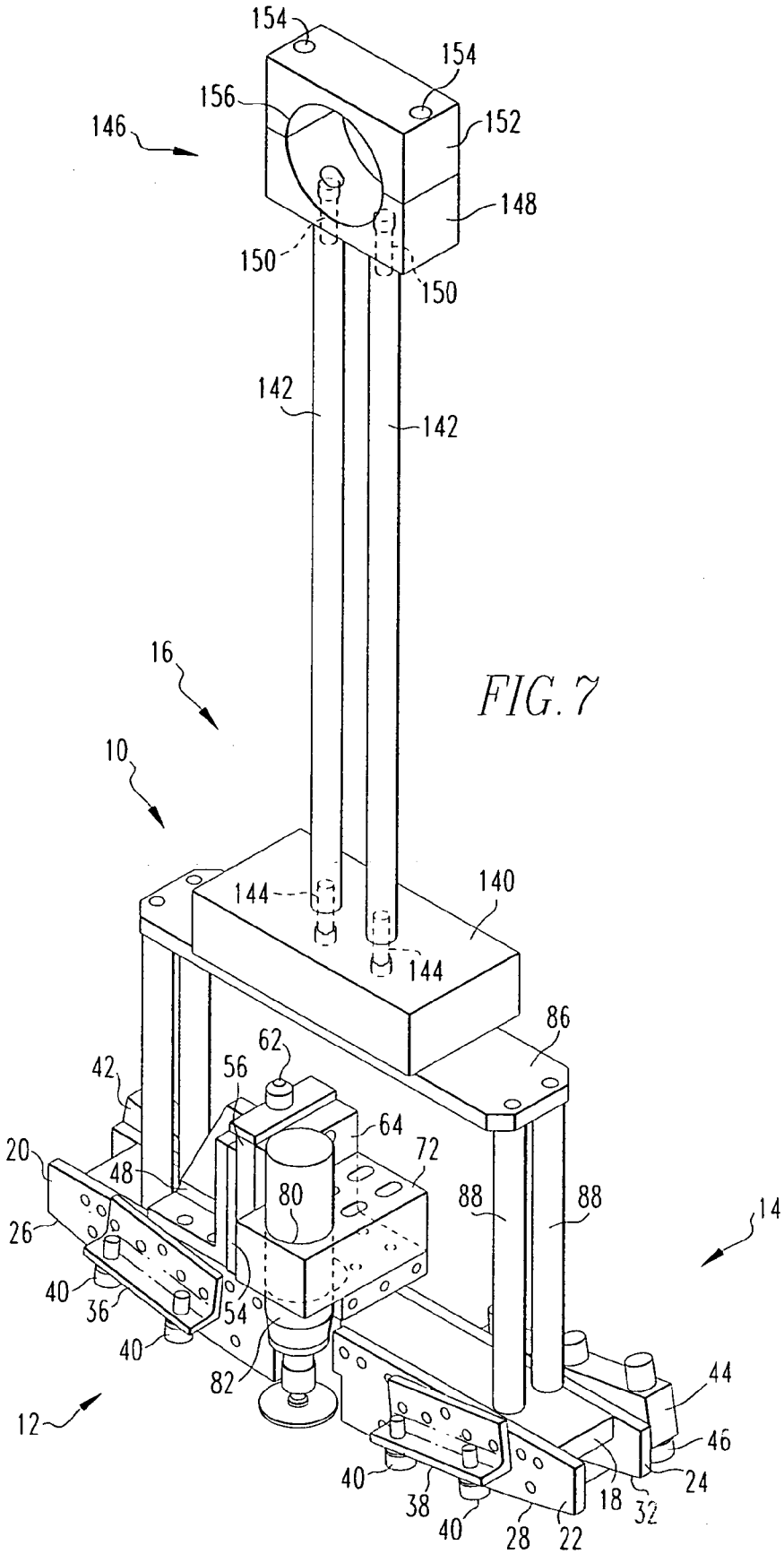
FIG. 7 is a side isometric view of a jig free grinder according to the present invention.
Figure 8:
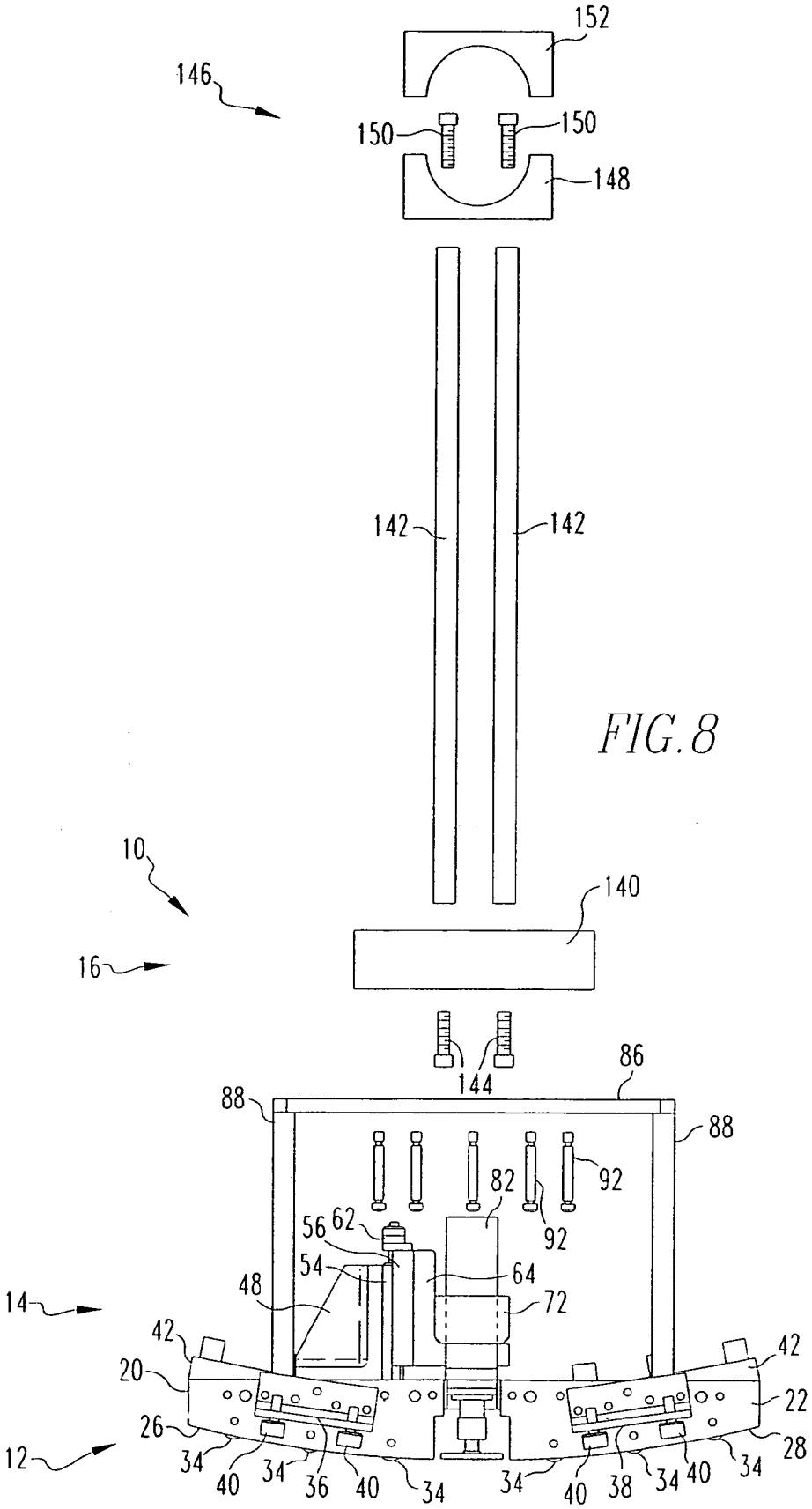
FIG. 8 is a partially exploded side view of a jig free grinder according to the present invention.

Referring to FIGS. 7–8, the jig 10 is illustrated configured for use in conjunction with a guide bar 114. The pivot block 90 has been replaced with a spring block 140, secured to the spring bar 86 by the bolts 92. At least one support leg 142 extends upward from the spring block 140, possibly being secured to the spring block 140 by the bolts 144. A clamp 146 is disposed at the top of the support legs 142. A preferred clamp 146 includes a bottom clamp portion 148 secured to the support legs 142 by the bolts 150. A top clamp portion 152 is secured to the bottom clamp portion 148, possibly by bolts passing through the apertures 154 defined within the top clamp portion 152, and into corresponding apertures within the bottom clamp portion 148. When secured together, the top clamp portion 152 and bottom clamp portion 148 define a hole 156 therethrough, structured to receive the guide bar 114 therethrough, while resisting rotation of the guide bar 114 with respect to the clamp 146.

Figure 9:
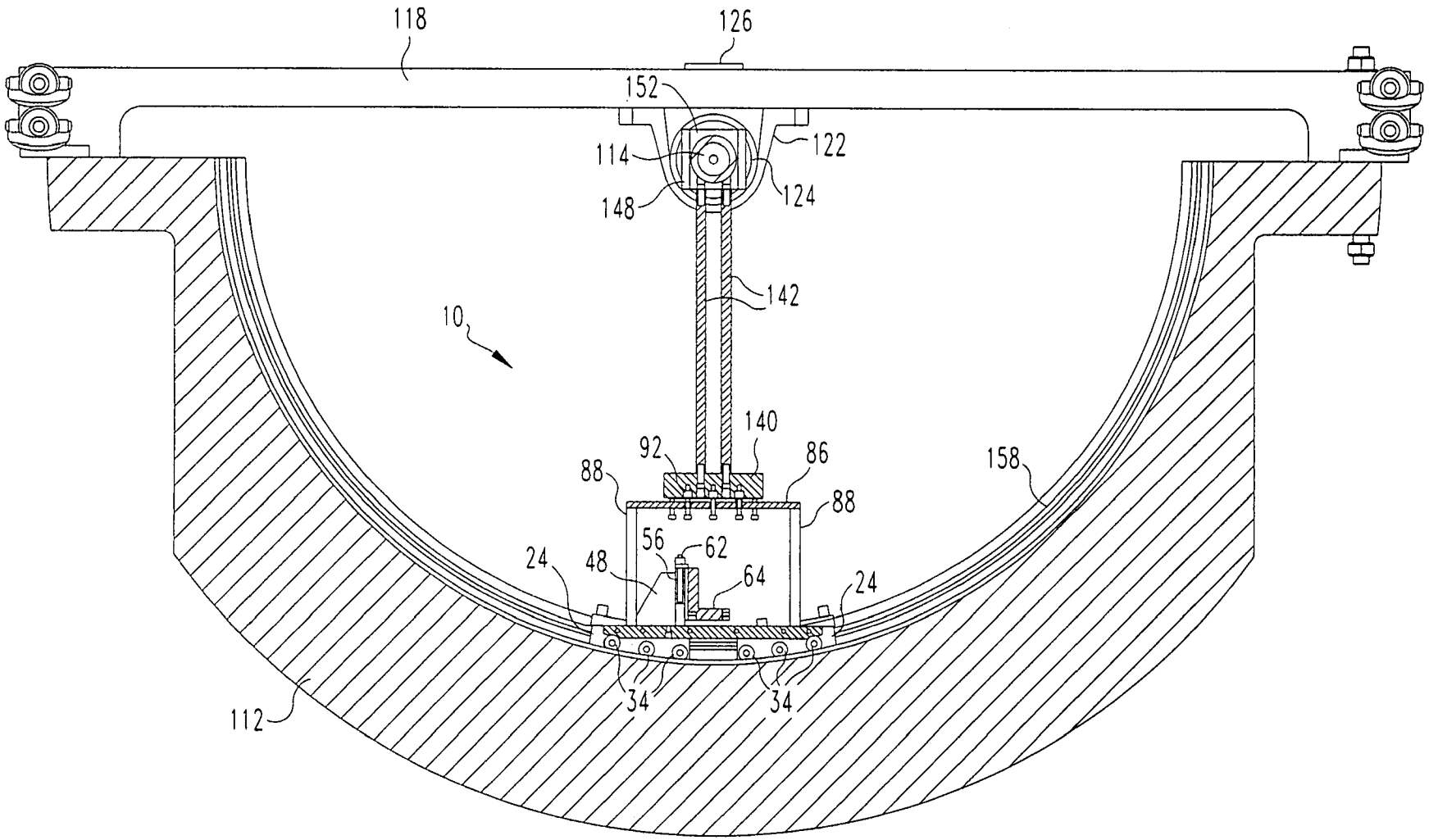
FIG. 9 is an environmental, partially sectional side view of a jig free grinder according to the present invention.

Referring to FIG. 9, when the clamp 146 is secured around the guide bar 114, the motor 124 may be used to rotate the guide bar 114, and thereby move the jig 10 along its desired path. Alternatively, if the clamp 146 is permitted to rotate with respect to the guide bar 114, or if the guide bar 114 is mounted in a manner that permits free rotation, the jig 10 may be manually moved along the desired path, with the connection between the guide bar 114 and spring block 140 maintaining the appropriate downward pressure on the jig 10. In either case, the jig 10 is guided along the channel 158.

The present invention therefore provides an apparatus that will guide a grinder through the proper path to grind weld repaired sections of a combustion turbine casing down to the proper dimensions, without the need to remove the rotor. The invention provides for vertical and horizontal movements of the grinder with respect to the jig to properly locate the grinder with respect to the weld repair on the casing. The jig is secured against lateral movement by rollers bearing against the hook fits, and against vertical movement by the pivot block bearing against the grinder. The jig facilitates grinding weld repaired sections of combustion turbine casings in general, and hook fits in particular, back to the desired size in less time than prior methods, and with greater accuracy and consistency than with prior methods.

While specific embodiments of the invention has been described in detail, it will be appreciated by those skilled in the art that various modifications and alternatives to those details could be developed in light of the overall teachings of the disclosure. For example, the rollers 34, 40, and 46 may be replaced by wheels and the dovetail slide may be replaced by overlapping tracks that slid with respect to each other. Accordingly, the particular arrangements disclosed are meant to be illustrative only and not limiting as to the scope of the invention which is to be given the full breadth of the appended claims and any and all equivalents thereof.

The invention claimed is:

1. A jig for repair of turbine casings, the jig comprising:

an elongated base having a top surface, a bottom surface, a first side, and a second side, the bottom surface being curved along its length to correspond to a curve of an inner surface of a turbine casing;

a plurality of bottom rollers disposed along the bottom surface;

a plurality of first rollers disposed along the first side;

a plurality of second rollers disposed on the second side; and a grinder base assembly secured to the top of the base, the grinder base assembly having means for securing a grinder therein.

2. The jig according to claim 1, wherein the first rollers are structured to reciprocate towards and away from the side, the first rollers being spring-biased away from the side.

3. The jig according to claim 2, wherein the grinder base assembly is structured to hold a grinder adjacent to the first side of the base.

4. The jig according to claim 1, wherein the second rollers have a fixed location with respect to the base.

5. The jig according to claim 1, wherein the grinder base assembly includes means for a grinder vertically and horizontally with respect to the base.

6. The jig according to claim 5, wherein the grinder base assembly includes a grinder clamp block structured for horizontal, lateral movement with respect to the base.

7. The jig according to claim 6, wherein the grinder clamp block is secured to the grinder base assembly by a plurality of bolts disposed within slots defined within the grinder clamp block.

8. The jig according to claim 5, wherein the grinder base assembly includes a slide and a slide base, the slide and slide base being secured to each other by a dovetail connection, the dovetail connection being structured to permit the slide to move vertically with respect to the slide base.

9. The jig according to claim 8, further comprising a screw lift mechanism for raising and lowering the slide with respect to the slide base.

10. The jig according to claim 1, wherein the grinder base assembly is disposed above the base.

11. The jig according to claim 1, further comprising means for biasing the jig downward against the turbine casing.

12. The jig according to claim 11, wherein the means for biasing the jig downward against the turbine casing include:

a spring bar extending above the top of the base; and a pivot block secured above the spring bar, the pivot block being spring-biased away from the spring bar, the pivot block defining a top surface structured to mate with a rotor of a turbine.

13. The jig according to claim 12 wherein:

the pivot block is secured to the platform by a plurality of bolts having springs disposed thereon; and the pivot block is structured to be drawn closer to the platform by tightening the bolts, and permitted to be pushed away from the platform under spring bias by loosening the bolts.

14. The jig according to claim 11, further comprising:

a guide frame structured to be secured to a cover of a turbine casing, the guide frame having a guide bar disposed substantially along a longitudinal axis of the cover; and a connection between the guide bar and the jig, the connection being structured to bias the jig downward against the turbine casing.

15. The jig according to claim 14, wherein the guide bar is rotatable.

16. The jig according to claim 15, wherein:

the guide bar is motor-driven; and the connection between the guide bar and the jig resists rotation of the guide bar with respect to the jig, whereby rotation of the guide bar moves the jig along the casing.

17. The jig according to claim 14, wherein the connection between the guide bar and the jig includes:

a spring bar extending above the top of the base;

a spring block secured above the spring bar;

a clamp structured for securing to the guide bar and for resisting rotation of the guide bar with respect to the clamp; and at least one support leg extending between the clamp and the spring block.

18. The jig according to claim 17, further comprising:

the spring block is secured to the platform by a plurality of bolts having springs disposed thereon; and the spring block is structured to be drawn closer to the platform by tightening the bolts, and permitted to be pushed away from the platform under spring bias by loosening the bolts.

* * * * *